United States Patent [19]

Ikeda et al.

[11] 4,132,498

[45] Jan. 2, 1979

[54] EARTH ANCHOR AND METHOD OF SETTING AND REMOVING SAME

[75] Inventors: Isamu Ikeda, Yokohama, Japan; Kunimitsu Yamada, 19-7, Tsurumaki 3, Setagaya-ku, Tokyo, Japan

[73] Assignees: Shigeru Sugimura; Kunimitsu Yamada, both of Tokyo, Japan

[21] Appl. No.: 877,695

[22] Filed: Feb. 14, 1978

[51] Int. Cl.[2] ..... E02D 5/74

[52] U.S. Cl. ..... 61/39; 405/284

[58] Field of Search ..... 61/39, 45 B; 52/155, 52/166

[56] References Cited

U.S. PATENT DOCUMENTS

| | | | |
|---|---|---|---|
| 3,754,401 | 8/1973 | Lipow | 61/45 B X |
| 4,000,623 | 1/1977 | Meardi | 61/39 |
| 4,069,677 | 1/1978 | Yamada et al. | 61/39 |

FOREIGN PATENT DOCUMENTS

| | | | |
|---|---|---|---|
| 540049 | 2/1977 | U.S.S.R. | 61/39 |

*Primary Examiner*—Jacob Shapiro

*Attorney, Agent, or Firm*—Meyer, Tilberry & Body

[57] ABSTRACT

An anchor removing device is constituted by providing a wedge shaped breaking means tapered in the drawing-out direction, which is temporarily secured to the tip portion of an anchor steel member and a tension steel member encompassed with sheath coupled to the wedge shaped breaking means. After this anchor removing device has been inserted into anchor hole which is bored in the ground, a hardenable filler material is injected into the anchor hole to form an anchor body. The hardenable filler material may produce voids or contains a foreign material of a low rigidity, which produces the effect similar to that of voids, such as air bubbles. The material may be foamable polystyrene and a cork of a given porosity. Typical example of the hardenable filler material is a foamed concrete milk. At the time of removing the anchor, the edge shaped breaking means is withdrawn by pulling the tension steel member with a jack or the like. Simultaneously with the withdrawal of the wedge shaped breaking means, the breaking means will break the anchor body covering same, thereby detaching the anchor body from the anchor steel member.

30 Claims, 14 Drawing Figures

EARTH ANCHOR AND METHOD OF SETTING AND REMOVING SAME

FIELD OF THE INVENTION

This invention relates to an anchoring process, which comprises supporting and fixing a temporary retaining wall and a multi-tied diaphragm wall or the like constituted of sheet piles, etc., and a device therefor.

DESCRIPTION OF THE PRIOR ART

For providing a trench at the time of construction of buildings, there is provided a temporary retaining wall using sheet piles in order to prevent the land around the ground to be bored, from collapsing. This temporary retaining wall is supported by a tied-back anchor, comprising anchor steel members buried in the ground in the rear portion of the wall and hardening material applied thereto such as cement milk, mortar or the like. Such a tied-back anchor is buried outwardly of the trench ground, and hence there is a fear that it gives an obstacle in the future which remains in the base portion of another building constructed adjacent to the building which is under construction. This poses a serious problem especially in over-congested urban area and the tied-back anchor has to be removed in the future.

Referring to the embodiments, description is given to the removal processes of prior art removal of such a tied-back anchor which gives an obstacle as mentioned earlier. According to one of the prior art processes, a pressure bearing plate is disposed in the radial direction of an anchor steel member at the tip portion of the anchor steel member encompassed with a sleeve and the pressure bearing plate is secured to the sleeve, while the anchor steel member is secured to the pressure bearing plate by clip means constituted such that the anchor steel member may be detached from the pressure bearing plate when a force greater than a given level of a force is exerted. In this case, by withdrawing the anchor steel member under a force greater than a given level, the anchor steel member is detached at the clip means from the pressure-bearing plate to be brought into a condition where the sleeve and the anchor steel member are unbonded, whereby the anchor steel member can easily be withdrawn. According to this process, however, only the anchor steel member may be withdrawn, leaving alone under the ground the anchor body made of a hardening material, sleeve and pressure bearing plate which will inevitably become obstacles. Thus, the removal process as described above suffers from a disadvantage that even the removal of the anchor body cannot be achieved.

According to another process, explosives are used to break the anchor body, thereby facilitating the removal of the anchor steel member and enabling simultaneous removal of the anchor body. That is, explosive covered with a tubular body is inserted together with the anchor steel member into anchor bored hole, followed by the injection of cement milk or mortar for rigidly locating same. At the time of removal, the explosive is fired by means of load-wire running from the explosive to break the anchor body. This process has an advantage in that the tied-back anchor can no longer be an obstacle in the future, since not only the anchor steel member is removed but also the anchor body (cement, mortar) can be also broken by explosion. In this process, however, there are problems with respect to water-proof property of the tubular body covering the explosive and firing system of the explosive. Insufficient water-proof property leads to wet explosive, whereby it fails to be exploded. On the other hand, accidents such as breaking of lead-wire at the time of charging explosives are liable to occur, resulting in unsuccessful removal of the tied-back anchor. Consequently, the tied-back anchor has to remain buried under the ground without being removed. Furthermore, this process suffers from lack of convenience because special device and technique are required for handling explosives.

Further, according to another prior art, a method is known which comprises the steps of providing a plurality of pressure bearing plates arranged in a given space to each other and being in threaded engagement with anchor steel members, and disposing sheaths between each of the pressure bearing plates for surrounding the anchor steel members and embedding the anchor into filler material in unbonded condition thereto, thereby fixing the anchor steel members therein with the effect of the withdrawal resisting force. Upon removal of the anchor, the threaded engagement of the pressure bearing plates with the anchor steel members is disengaged. In this method it is required to enlarge the diameter of the pressure bearing plates so as to provide a given supporting force, resulting in the need to bore a large anchor hole in the ground. The increment in the diameter of the hole causes problems in aconomy and construction.

SUMMARY OF THE INVENTION

Accordingly, it is a principal object of the present invention to provide an anchoring process which allows the removal of an anchor steel member with ease by breaking an anchor body secured to the anchor steel member to thereby allow no rod-shaped anchor body left under the ground, with the aid of a removal device of a simple construction utilizing a wedge effect, and a hardenable filler material producing voids or a foreign material of a low rigidity which affords the similar effect to that of voids. The filler material aids in affording the wedge effect.

Another object of the present invention is to provide an anchoring process in which there are provided two or more anchor steel members which can be provided, as required depending on a supporitng force required.

Still another object of the present invention is to provide an anchoring process having a means for securing temporarily two or more anchor steel members arranged at a given spacing to outer peripheral portion of a wedge-shaped breaking means.

It is also another object of the present invention to provide an anchoring process in which there is provided a means capable of reducing frictional resistance caused between the wedge shaped breaking means and filler material at the time of withdrawing the wedge shaped breaking means.

It is still another object of the present invention to provide an anchoring process in which a tension steel member is inserted into through-hole along the center axis of the wedge shaped breaking means and secured by clamping means to the diverging end portion of the breaking means wherein the breaking means gradually acts along the direction of the anchor steel member to be pulled, without departing from the axis of the anchor body.

It is also still another object of the present invention to provide an anchoring process having a foreign material of a low rigidity for forming a filler material which is readily broken by the wedge shaped breaking means.

Furthermore, still another object of the present invention is to provide an anchoring device which can remove an anchor steel member with ease and also break an anchor body.

DRAWING FIGURES

FIG. 1 shows a longitudinal cross-sectional view in which a supporting wall is supported by a tied-back anchor;

FIG. 2 a side view of a wedge shaped breaking means, as viewed from the diverging end portion thereof;

FIG. 3 a view of appearance of a wedge-shaped breaking means;

FIG. 4 a side view of an anchor steel member and a breaking means in the fixed condition;

FIG. 5 a view of a partial appearance of an anchor steel member and a breaking means in the fixed condition;

FIG. 6 a side view of a breaking means having blade shaped projections;

FIG. 7 a view of appearance of the breaking means shown in FIG. 6;

FIG. 8 a side view of a breaking means, exhibiting another embodiment of a means for securing tension steel member in position;

FIG. 9 a view of appearance of the breaking means shown in FIG. 8; and

FIG. 10 through FIG. 14 longitudinal cross-sectional views shown in the order of steps of the anchoring process of the present invention.

DETAILED DESCRIPTION

Figure 1:
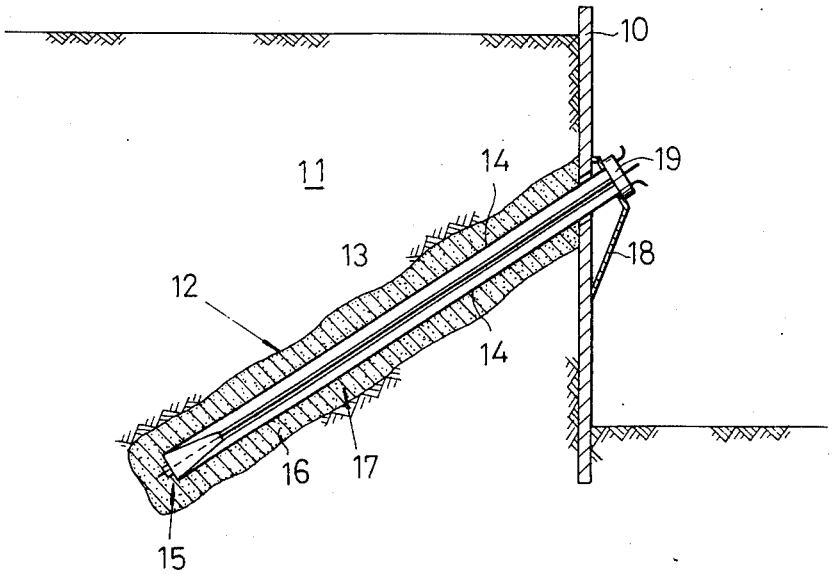

With reference to the preferred embodiment as illustrated in the drawing, the present invention will be described in more detail as below. FIG. 1 shows a longitudinal cross sectional view of a supporting wall 10 such as temporary retaining wall illustrative of the supported condition according to the anchoring process of the present invention. The supporting wall 10 is supported and fixed by a tied-back anchor 12 buried in a ground 11. The tied-back anchor includes an anchor steel member 14 and an anchor removing means 15, inserted into an anchor bored hole 13 bored in the ground 11, and an anchor body 17 of a hardenable filler material 16 injected into the anchor bored hole 13 to be solidified therein.

The anchor steel member 14 to be used is preferably a strand wire of steel and secured by a fastening piece 19 on a pressure bearing block 18 provided on the outer surface of the supporting wall 10. The number of the anchor steel member may be either single or plural, depending on the supporting force required. Depending on whether the anchor steel member 14 is single or plural, the constitution of the anchor removing means 15 as hereinafter described is somewhat different; but it should be noted that there is no fundamental difference between these embodiments. In the present embodiment, description is given with reference to plural anchor steel members.

Figure 2:
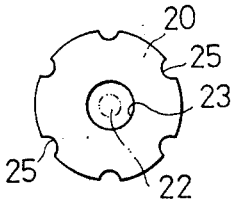
Figure 3:
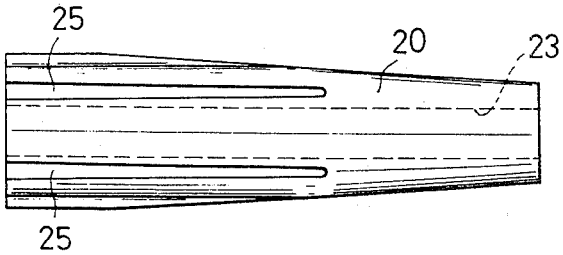
Figure 4:
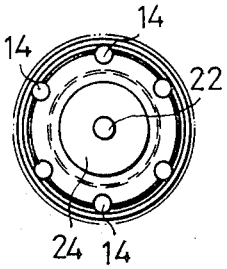
Figure 5:
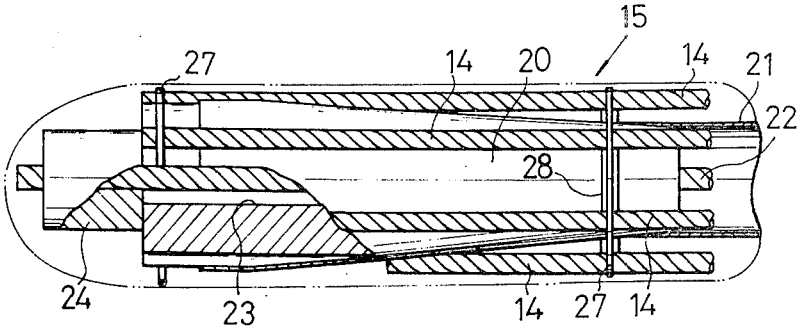
Figure 6:
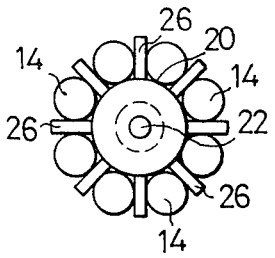
Figure 7:
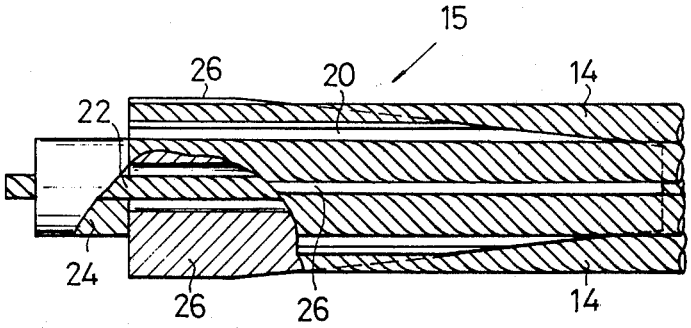
Figure 8:
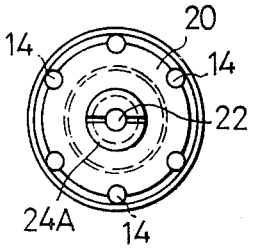
Figure 9:
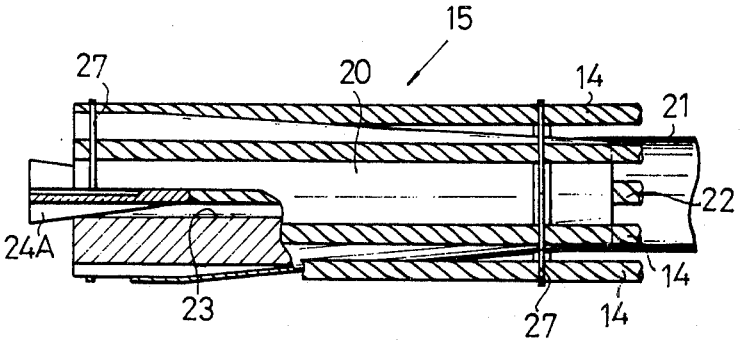

FIG. 2 and FIG. 3 show one embodiment of the constitution of the anchor removing means 15. The anchor removing means 15 is equipped with a wedge-shaped breaking means 20 tapered in the direction to be pulled (namely, toward the opening side of the anchor hole 13) and a tension steel member 22 encompassed with a sheath 21 to be insulated from the filler material 16. In the central portion along the axis of the wedge-shaped breaking means 20, there is provided a through-hole 23. As shown in FIG. 4 and FIG. 5, the tip portion of the tension steel member is inserted into this through-hole 23 and secured by a fixing means 24 to the diverging end portion of the breaking means 20. The inner diameter of the tension steel member 22 and hence the tension steel member 22 is loosely fitted in the through-hole 23 so as to be movable in the directions except for the direction to be pulled. The tension steel member 22 is preferably made of a strand wire of steel having flexibility in order to avoid stress concentration due to a tension when pulled. In the peripheral surface of the wedge-shaped breaking means 20, there are provided grooves corresponding in number to the anchor steel members 22 to be fitted therein in parallel with the axis direction of the breaking means 20. The gradient of the peripheral surface of the breaking means 20 is suitably determined, depending on the soil of the ground 11 surrounding the anchor body 17, a side arresting force determined by the soil, a frictional resistance with the anchor body 17, a breaking strength of the anchor body 17, etc. Alternatively, the breaking means may also be constituted as shown in FIG. 6 and FIG. 7. That is, in order to reduce the frictional resistance on the outer periphery of the breaking means 20, there radially project blade-shaped projecting portions 26 on the peripheral surface of the breaking means 20. The projecting portions 26 may be tapered at a certain gradient. Another embodiment of fixing means for securing the tension steel member 22 to the breaking means 20 is shown in FIG. 8 and FIG. 9, in which a wedge part 24A fittable in the through-hole 23 is used in place of the fixing means 24.

The hardenable filler material 16 is composed of a hardenable material such as cement milk, mortar or others, which contains ingredients producing a plurality of voids or a plurality of a foreign material of a low rigidity, which affords an effect similar to that of voids. Induced by foreign materials of low rigidity are rubber granules, hollow synthetic resin granules, synthetic resin foams, cork granules and so on, which are capable of forming discrete cells in the filler material 16. Alternatively, there may also be used a cylindrical body having continuous void, such as polyvinyl chloride pipe or a paper cylinder as foreign material of a low rigidity. Owing to the effect of the void or foreign material thus incorporated into the filler material 16, a stress concentration tends to take place in the filler material 16 when an external force is imposed thereon, resulting in a lowered strength. This is related with the supporting strength of the tied-back anchor. As a matter of course, the strength achieved in the presence of voids or in the case of the use of foreign materials of low rigidity is greater than the supporting strength required by the fixing anchor 12.

Turning now to FIG. 10 through FIG. 14, an anchoring process and anchor removing process according to the present invention are described. First, as shown in FIG. 4 and FIG. 5, two or more anchor steel members 14 are fitted in grooves 25 in the breaking means 20 and a binding band 27 of relatively low strength is wound around the entire circumference of the anchor steel members 14 to have the breaking means 20 temporarily integrally secured to the tip portion of teh anchor steel member group 14. Wound around the entire peripheral surface of the breaking means and the anchor steel members 14 is a tape 30 for insulating same from the filler material 16. However, the tape 30 is provided not only for the purpose of insulating from the filler material 16, but also preventing the sheath 21 from permeation of the filler material 16 from the joint portion between the breaking means 20 and the sheath 21 and other gaps. In this respect, the filler material is injected into the anchor hole under such a high pressure to be flown into the sheath 21 if it finds a small gap. If the filler material is flown into the sheath 21 and hardened therein, the starting tension load should be increased upon removal of the anchor steel members 14, thus requiring a large sized jack, which is an undesirable situation. In the drawings, shown at 28 is a ring inserted between the breaking means 20 and the anchor steel member 14 to hold the anchor steel member 14 in parallel with the center axis of the breaking means.

Figures 10, 11, 12, 13, 14:
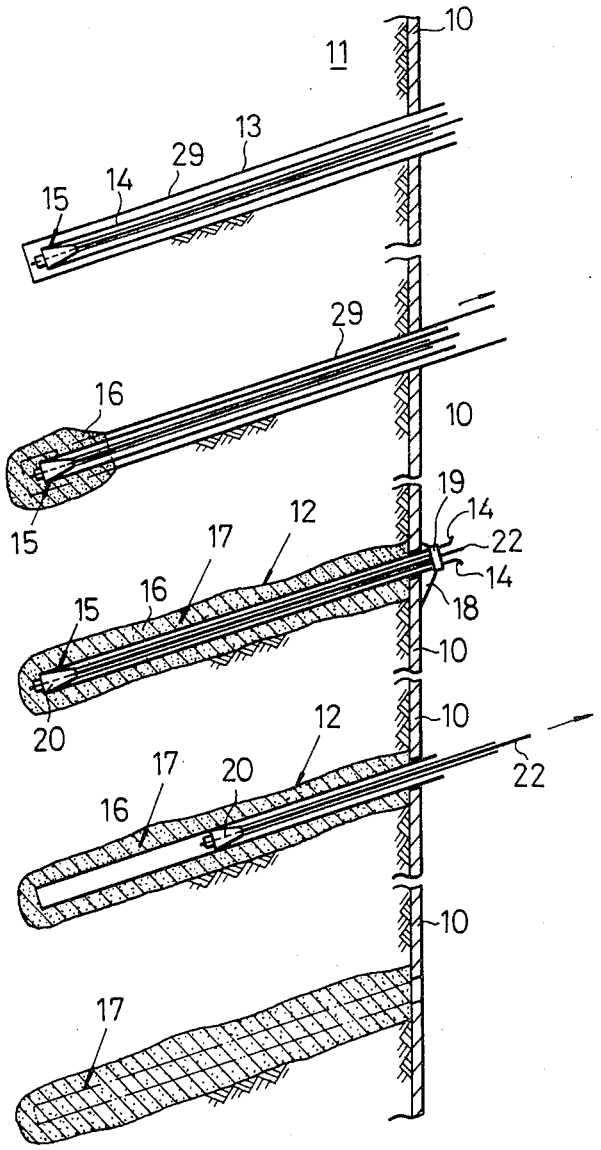

Then, as shown in FIG. 10, the assembled anchor steel member 14 and anchor removing means 15 encased in a cylindrical casing 29 are inserted into the anchor bored hole 13. Subsequently, as shown in FIG. 11 and FIG. 12, the hardenable filler material 16 is injected under a high or low pressure according to the ground condition into the bored hole 13 while pulling the casing 29. And, while leading out the anchor steel member 14 and the tension steel member 22 outwardly, the edge portions thereof are secured by a fastening means 19 on a pressure bearing block 18 provided on the outer surface of the supporting wall 10. According to such a procedure, the tied-back anchor 12 is set, whereby the supporting wall 10 is supported by a bonding force created between the anchor steel member 14 and the filler material 16.

Upon removing the tied-back anchor 12, the breaking means 20 is withdrawn by applying a tension load therein by means of a jack (not shown), as shown in FIG. 13 and FIG. 14. At this time, due to the wedge-shaped breaking means 20, a breaking stress acts on the surrounding filler material 16, namely the anchor body 17 so as to produce cracking. The voids or foreign materials of a low rigidity incorporated in the filler material 16 greatly contribute to production of such cracks. Furthermore, the breaking means 20 gradually acts along the direction of the anchor steel member 14 to be drawn, without departing from the axial line of the anchor body 17, thus causing cracks. On the withdrawal of the breaking means 20 in the aforesaid manner, the anchor body 17 is broken to detach the anchor body 17 from the anchor steel member 14, thereby placing the anchor steel member 14 in a condition independent of the anchor body 17.

After the breaking means 20 have been taken out, the anchor steel member 14 can manually be pulled out from the ground with ease.

Though the specific description is given to the embodiment using a plurality of the anchor steel members, it will be appreciated that single anchor steel member is also applicable to the present invention. Within the range of the required supporting force, a single anchor steel member will be used. In this case the diameter of the anchor hole 13 can be lessened, resulting in saving of the expenses in the construction.

As described above, according to the present invention, the anchor steel member can be taken out, and the anchor body may be broken of the anchor. As the result, no fixing anchor will not be left alone as a rod-shaped body under the ground. Furthermore, the anchor steel member may be pulled and the anchor body broken as described above without very a special device in a simple manner, as best. This greatly contributes to an efficient operation and saving in operational expense.

What is claimed is:

1. For use in an earth bore-hole to be encased in a shroud of frangible low strength hardenable material to anchor an excavation site structure, a shroud breaking earth anchor comprising: a cone-shaped anchor-wedge; a cable fastening collar; a central tie-back cable secured at one end to said anchor-wedge and at its other end to said cable fastening collar, means encasing said central tie-back cable against seepage of said frangible hardenable material between said anchor-wedge and said cable fastening collar, said cable fastening collar being securable to the excavation site structure to be anchored; and means to tension said tie-back cable sufficiently to draw said anchor-wedge into breaking engagement with said frangible hardenable material subsequent to hardening.

2. The device of claim 1, including a plurality of tie-back cables secured at their one ends to the periphery of said cone-shaped anchor-wedge and at their other ends to said fastening collar, said plurality of tie-back cables being positioned exterior of said sleeve and parallel thereto.

3. The device of claim 1, wherein said cone-shaped anchor-wedge is tapered toward said fastening collar.

4. The device of claim 1, wherein a said anchor-wedge is provided with a concentric through-hole to receive said one end of said tie-back cable therethrough and means to clamp said one end adjacent the portion of said anchor-wedge remote from said fastening collar.

5. The device of claim 1, wherein said anchor-wedge and sleeve are encased in a frangible hardenable material.

6. The device of claim 1, wherein said anchor-wedge and sleeve are encased in a frangible hardenable material which is provided with voids to reduce its resistance to rupturing when hardened.

7. The device of claim 1, wherein said anchor-wedge and sleeve are encased in a frangible hardenable material which is provided with foreign particulates to reduce its resistance to rupturing when hardened.

8. The device of claim 1, wherein said anchor-wedge and sleeve are encased in a frangible hardenable material in which is embedded a low strength tube to reduce the rupturing strength of said material when hardened.

9. The device of claim 1, wherein said earth anchor is located in an earth bore-hole and encased in said frangible hardenable material, and said cable fastening collar is anchored to said excavation site structure.

10. The device of claim 2, wherein said anchor-wedge is provided with a plurality of parallel, longitudinal grooves spaced about the periphery of said anchor-wedge to receive said tie-back cable one ends therein.

11. The device of claim 2, wherein said anchor-wedge is provided with a plurality of wedge-shaped fins secured about the periphery of said anchor-wedge to receive said tie-back cable one ends therebetween, said fins being tapered toward said cable fastening collar.

12. The device of claim 2, wherein said anchor-wedge sleeve and plurality of tie-back cables are encased in a frangible hardenable material.

13. The device of claim 4, wherein said clamping means comprises a cylindrical collar to fit about said one end of said tie-back cable.

14. The device of claim 4, wherein said clamping means comprises a split conical collar to fit about said one end of said tie-back cable and to wedge into the entrance to said through-hole remote from said cable fastening collar.

15. The device of claim 5, wherein said sleeve is sealed against penetration by said frangible hardenable material.

16. The device of claim 9, wherein said frangible hardenable material is provided with voids to reduce its resistance to rupturing when hardened.

17. The device of claim 9, wherein said frangible hardenable material is provided with foreign particulates to reduce its resistance to rupturing when hardened.

18. The device of claim 9, wherein a low strength tube is embedded in said frangible hardenable material to reduce the rupturing strength of said material when hardened.

19. The device of claim 12, wherein said sleeve and plurality of tie-back cables are sealed against penetration by said frangible hardenable material.

20. The device of claim 19, wherein said frangible hardenable material is degraded with foreign materials to render it more susceptible to rupturing when stressed in the hardened condition.

21. The device of claim 20, including means to stress said frangible hardened material to failure by rupture.

22. The device of claim 21, wherein said means to stress said frangible hardened material includes means to place said central tie-back cable in tension whereby said anchor-wedge is caused to rupture said frangible hardened material by being drawn through the center portion thereof.

23. For use in an earth bore-hole to anchor an excavation site structure, an earth anchor comprising: a cone-shaped anchor-wedge; a cable fastening collar secured to said excavation site structure; a central tie-back cable secured at one end to said anchor-wedge and at its other end to said cable fastening collar; a sleeve encasing said central tie-back cable between said anchor-wedge and said cable fastening collar; a plurality of tie-back cables arranged in parallel about the periphery of said anchor-wedge and secured thereto at their one ends and secured at their other ends to said cable fastening collar; means to seal said plurality of cables and said sleeve against penetration by a frangible fluid hardenable material; encasement of said sealed plurality of cables in said frangible fluid hardenable material, said material being pre-weakened in compressive, shear and tensile strengths to render said material when hardened readily destructable when stressed; and means to stress said frangible hardened material to destruction including means to tension said central tie-back cable at the entrance to said bore-hole whereby said anchor-wedge is pulled through the hollow center of said frangible hardened material formed by said sealed plurality of cables to fracture said frangible hardened material, thereby to permit removal of said central tie-back cable and said anchor-wedge from said bore-hole.

24. The method of preparing an earth anchor for insertion in and removal from an earth bore-hole to temporarily anchor an excavation site structure comprising the steps of:

(a) inserting a tie-back cable in a rigid sleeve;
(b) securing the ends of said tie-back cable between an anchor-wedge and a cable fastening collar;
(c) sealing said sleeve against intrusion of a fluid but hardenable substance;
(d) inserting a combination anchor-wedge, tie-back, cable-sleeve, fastening collar assembly anchor-wedge first into a bore-hole;
(e) anchoring said cable fastening collar to said excavation site structure;
(f) preparing a low strength hardenable material which is frangible when hardened and having predetermined low compressive, tensile and shear strengths;
(g) injecting said hardenable material into said bore-hole to encase said anchor-wedge, tie-back, cable-sleeve assemblage;
(h) permitting said hardenable material to harden;
(i) withdrawing said anchor-wedge from said bore-hole by applying tension to said tie-back cable at the bore-hole entrance whereby said anchor-wedge crushes said frangible low strength hardened material as it is being drawn toward the bore-hole entrance.

25. The method of claim 24, including the steps of:

(j) securing a plurality of tie-back cables exterior of said sleeve between said anchor-wedge and said cable fastening collar;
(k) sealing said plurality of cables against intrusion of said hardenable material between said plurality of tie-back cables, said anchor-wedge and said sleeve;
(l) withdrawing said plurality of tie-back cables from said bore-hole after said frangible hardened material has been crushed by said anchor-wedge.

26. The method of claim 24, including the step of:

(m) lowering the compressive, tensile and shear strengths of said hardenable material by the inclusion therein of voids.

27. The method of claim 24, including the step of:

(n) lowering the compressive, tensile and shear strengths of the frangible hardened material by the inclusion therein of foreign particulates.

28. The method of claim 24, including the step of:

(o) lowering the compressive, tensile and shear strengths of the frangible hardened material by the inclusion therein of at least one low strength tube.

29. The method of claim 24, including the step of:

(p) lowering the compressive, tensile and shear strengths of the frangible hardened material by the inclusion therein of granules of a synthetic plastic.

30. The method of claim 24, including the step of:

(q) tapering said anchor-wedge toward the bore-hole entrance to increase the crushing efficiency of said anchor-wedge.

* * * * *

UNITED STATES PATENT AND TRADEMARK OFFICE

CERTIFICATE OF CORRECTION

PATENT NO. : 4,132,498

DATED : January 2, 1979

INVENTOR(S) : Isamu Ikeda and Kunimitsu Yamada

It is certified that error appears in the above-identified patent and that said Letters Patent are hereby corrected as shown below:

First page, insert in INID Code listings:

-- [30] Foreign Application Priority Data
February 17, 1977 Japan...52-15547 --

In the Abstract, line 16, "edge" should read -- wedge --

Signed and Sealed this

*Eleventh* Day of *December 1979*

[SEAL]

*Attest:*

SIDNEY A. DIAMOND

*Attesting Officer*

*Commissioner of Patents and Trademarks*